US012078362B1

(12) United States Patent
Kaplan

(10) Patent No.: US 12,078,362 B1
(45) Date of Patent: Sep. 3, 2024

(54) SAFE DOMESTIC HOT WATER (DHW) SYSTEM AND METHOD THAT SAVES WATER AND ENERGY

(71) Applicant: Neil B. Kaplan, Hull, MA (US)

(72) Inventor: Neil B. Kaplan, Hull, MA (US)

( * ) Notice: Subject to any disclaimer, the term of this patent is extended or adjusted under 35 U.S.C. 154(b) by 0 days.

(21) Appl. No.: 18/626,938

(22) Filed: Apr. 4, 2024

Related U.S. Application Data

(60) Provisional application No. 63/605,671, filed on Dec. 4, 2023.

(51) Int. Cl.
*F24D 19/10* (2006.01)

(52) U.S. Cl.
CPC ..... *F24D 19/1051* (2013.01); *F24D 19/1015* (2013.01); *F24D 2220/044* (2013.01)

(58) Field of Classification Search
CPC ..... F24D 19/1015; F24D 2220/044
See application file for complete search history.

(56) References Cited

U.S. PATENT DOCUMENTS

| | | | | |
|---|---|---|---|---|
| 5,233,970 | A | 8/1993 | Harris | |
| 9,170,584 | B2 | 10/2015 | Lum et al. | |
| 9,909,780 | B2 | 3/2018 | Humphrey et al. | |
| 10,480,862 | B2 | 11/2019 | Rajagopalan et al. | |
| 11,047,602 | B2 | 6/2021 | Adjabeng et al. | |
| 11,226,136 | B2 * | 1/2022 | Knoblett | F24H 9/142 |
| 2009/0092384 | A1 | 4/2009 | Luo et al. | |
| 2012/0255706 | A1 | 10/2012 | Tadayon et al. | |
| 2014/0131462 | A1 | 5/2014 | Stevens et al. | |
| 2018/0106497 | A1 | 4/2018 | Seitz | |
| 2020/0191433 | A1 | 6/2020 | Yin et al. | |
| 2023/0175736 | A1 * | 6/2023 | Knoblett | F24H 9/2007 122/14.3 |
| 2023/0324052 | A1 | 10/2023 | Hayden et al. | |

FOREIGN PATENT DOCUMENTS

| | | | | |
|---|---|---|---|---|
| CN | 109282486 A * | 1/2019 | | F24H 1/201 |
| JP | 2016156185 A | 9/2016 | | |
| WO | WO-2008070906 A1 * | 6/2008 | | F24D 17/0031 |
| WO | 2023158583 A1 | 8/2023 | | |

* cited by examiner

*Primary Examiner* — Gregory A Wilson
(74) *Attorney, Agent, or Firm* — VLP Law Group, LLP; David J. Thibodeau

(57) ABSTRACT

A hot water system, such as a Domestic Hot Water (DHW) system, combines the best characteristics of a tankless heater and a hot water storage tank to provide superior energy and water savings and safety. The storage tank does not need an internal heat source. Tank hot water may be recovered through the tankless heater. A first control (A) activates hot water recirculation from the storage tank to safely heat pipes to supply, for example, a sink, with no wasted water. The tankless heater supplies a greater demand, such as for a shower or tub. A second control (B) activates a cold-water diverter to the supply from the storage tank to the tankless heater. A water flow sensor keeps the tankless heater as the hot water source until the water flow stops. The so-called cold-water-sandwich is eliminated, and waste of water or heat is reduced.

18 Claims, 9 Drawing Sheets

| Section 33a Calculations Sheet 134° - 140° | | | | |
|---|---|---|---|---|
| System Net Volts DC | 12.6 | vdc | | Voltage in B1 is net VCC |
| Actual Circuit Board Part Number | Patent Schematic Item Number | | | **Column C Formula or Setting** |
| Total Inline Goal Ω | | 4,335 | Ω | Manual Adjustment / Test |
| R10 Ω | 106 | 910 | Ω | Manual Adjustment / Test |
| 5K Potentiometer | 112 | 3,250 | Ω | =C5-C6 |
| R3 | 108 | 18,000 | Ω | Manual Adjustment / Test |
| Net Resistance | | 3,379 | Ω | =1/(1/(C8+C9)+1/C10) |
| Net Ohm Goal | | 2,736 | Ω | |
| **Off Temperature** | | **140** | **°F** | Tankless Pump Turned OFF |
| Thermistor | 104 | 3,041 | Ω | From 10K-4 Thermistor Table for 140 °F |
| Pin 4 **Off Volts** | Pin 4 of 33a | **6.63** | vdc | =C11/(C11+C14)*B$3 |
| When Pin 5 drops below 6.30 volts, 33a turns on, pin 4 goes up to 6.63 volts with hysteresis influence by transistor 130 turning on. Now, pin 5 won't turn 33a off until pin 5 reaches 6.64 volts when temperature reaches 140 °F | | | | |
| **On Temperature** | | **134** | **°F** | Tankless Pump Turned ON |
| Thermistor | 104 | 3,387 | Ω | From 10K-4 Thermistor Table for 134 °F |
| Pin 5 **On Volts** | Pin 5 of 33a | **6.29** | vdc | =C11/(C11+C19)*B$3 \| volts to turn ON |

FIG. 3

| "Pot" is Potentiometer | | | | 2 resistors pot in middle | | | | | | | |
|---|---|---|---|---|---|---|---|---|---|---|---|
| 12.6 | vdc | Max Turn 270° | | | | | | | | Wiper | Wiper |
| Pot Position | Run Seconds | ° Pot Turn | % of circle | resistor 10 | R10 side Pot Ω | Net Top Side | resistor 32 | R32 side Pot Ω | Net Lower Side | Net bus 31 | Goal vdc |
| d | 120 | 0 | 0% | 5100 | 0 | 5100 | 1000 | 5000 | 6000 | 5.79 | 5.74 |
| c | 90 | 64 | 24% | 5100 | 1200 | 6300 | 1000 | 3800 | 4800 | 7.15 | 7.06 |
| b | 60 | 138 | 51% | 5100 | 2600 | 7700 | 1000 | 2400 | 3400 | 8.74 | 8.55 |
| a | 30 | 222 | 82% | 5100 | 4200 | 9300 | 1000 | 800 | 1800 | 10.56 | 10.36 |

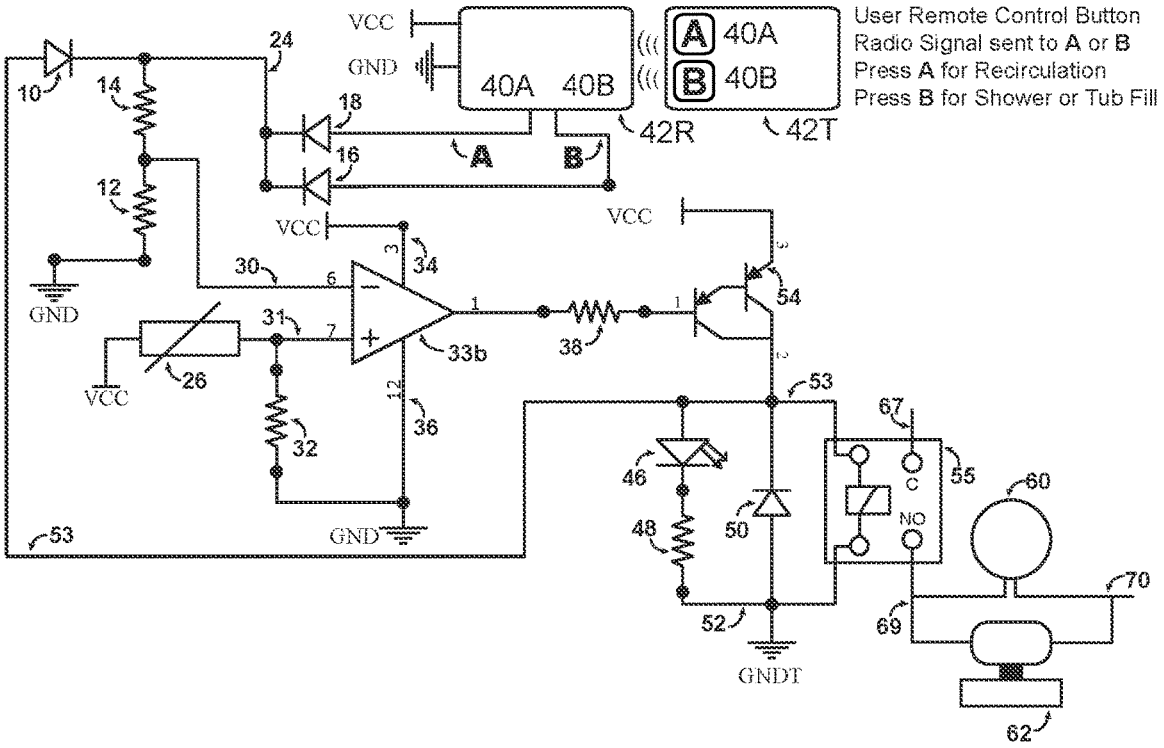

FIG. 5A

| | | | | | | |
|---|---|---|---|---|---|---|
| | Net volts on bus **24** | 12.6 | | | Resistor values | | |
| | Thermistor **26** Ω @ 70° F | 11,720 | | | Net volts on bus **24** | 12.6 | |
| | Thermistor **26** Ω @ 108° F | 5,053 | | | R 14 | 5,100 | |
| | | | | | R 12 | 5,600 | |
| | | | | | **Volts at Pin 6** | 6.59 | |
| | | | | | | | |
| | | | | | | | |
| | Pin 7 of 33b at **70°F** room temperature | | | | Pin 7 of 33b at **108°F** hot temperature | | |
| | Thermistor 26 | 11,720 | Ω | | Thermistor 26 | 5,053 | Ω |
| | Volts at VCC | 12.6 | volts | | Volts at VCC | 12.6 | volts |
| | R32 | 5,600 | Ω | | R32 | 5,600 | Ω |
| | Pin 7 | 4.07 | volts | | **Volts at Pin 7** | 6.62 | volts |
| | | | | | | | |
| | | | | | | | |
| | Since Pin 7 of 33b is lower than Pin 6, 33b will not turn off | | | | Pin 7 is now higher than pin 6, 33b will turn off | | |
| | | | | | and preheating pump 60 will turn off. | | |
| | | | | | | | |

FIG. 5B

SAFE DOMESTIC HOT WATER (DHW) SYSTEM AND METHOD THAT SAVES WATER AND ENERGY

BACKGROUND

Technical Field

The various embodiments and aspects described herein relate to hot water storage tanks, tankless hot water heaters and not to hybrid hot water systems. It is also related to preheating of bathroom water pipes.

Description of Related Art

U.S. Pat. No. 9,170,584 B2 is a hot water circulation system that uses a bypass valve. It bridges a connection from the sink hot side to the sink cold under a vanity.

U.S. Pat. No. 9,909,780 B2 explains how to maintain a tankless system output temperature and activate a pump if it is too low. A controller has a stored temperature default for the tankless system.

U.S. Pat. No. 10,480,862 B2 incorporates a heat exchanger to transfer heat to the domestic hot water system.

U.S. Pat. No. 8,498,523 B2 is a hybrid system utilized with a primary and secondary heating system. A tankless and tank subsystem each have their own heating source.

BRIEF SUMMARY OF PREFERRED EMBODIMENTS

In an aspect disclosed herein, a system and method for safe and efficient delivery of hot water by preheating hot water pipes in a particular way is disclosed.

More particularly, a user control input (A) may start a preheating pump that sends hot water from a hot water storage tank through a closed piping loop, which returns room temperature water that may exist in the pipes.

A branch piping circuit may allow for at least one input and at least two outlets for apportionment of room temperature return water. A tempering valve having a cold-input and a hot-input may be used to temper safe hot water. A valve may control what portion of return water is drawn directly into its cold-input from the branch piping circuit outlet. The tempering valve controls what portion of hot water is drawn into the valve hot-input from a storage tank hot-output, forcing the storage tank to draw that same water volume into its cold-input from room temperature return water through the branch piping circuit outlet. The tempering valve may now output safe hot water.

An electronic control circuit may turn the preheating pump off when a preset temperature has been reached. In addition, or alternatively, an electronic circuit may turn the preheating pump off when a preset time limit has been reached.

An electric valve in the return water pipe may open when the preheating pump is on and may close when preheating pump is off. This electric valve may prevent a potential thermosiphon from occurring in the closed piping loop.

A hot water storage tank may supply hot water for low and medium hot water demand, such as at a bathroom sink. A tankless heater may supply hot water to satisfy higher hot water demand like at a shower or for a tub fill.

A user control (B) may activate the tankless heater by controlling a cold-water diverter that may redirect cold water to enter the tankless heater cold input instead of the storage tank cold input, thus enabling the tankless heater to be the supplier of hot water.

A cold-water diverter may be kept in position by a timer and a water flow sensor. When the water flow sensor indicates that water use has ended or the preset time limit has been reached, the cold-water diverter may revert the cold-water supply to the storage tank cold-water input and no longer to tankless heater, which may then enable the storage tank to be the supplier of hot water.

User control (B) may also activate a pump to send the initial cold-water output from the tankless heater into the hot water tank to assure that cold water never enters the hot water pipes. A water flow sensor may stop the tankless pump operation when use of water is detected or when a preset time limit has been reached.

A tank thermostat and tankless pump may also recover the hot water storage tank temperature by cycling hot water stored tank water through the tankless heater.

As a result, the system and method provide water at a precise, controllable temperature, to at a faucet as rapidly as possible, and with minimal water wasted.

BRIEF DESCRIPTION OF THE SEVERAL FIGURES

FIG. 2A illustrates a left side of the circuit, including Section A and Section B, and FIG. 2B illustrates a right side of the circuit, including Section C and Section D.

FIG. 3 shows calculations for tank temperature control with six (6) degrees of hysteresis.

FIG. 5A is a circuit showing how the preheating pump can turn off by temperature limit only.

FIG. 5B is a table of parameters for the circuit of FIG. 5A.

DETAILED DESCRIPTION OF PREFERRED EMBODIMENTS

Figure 1A:
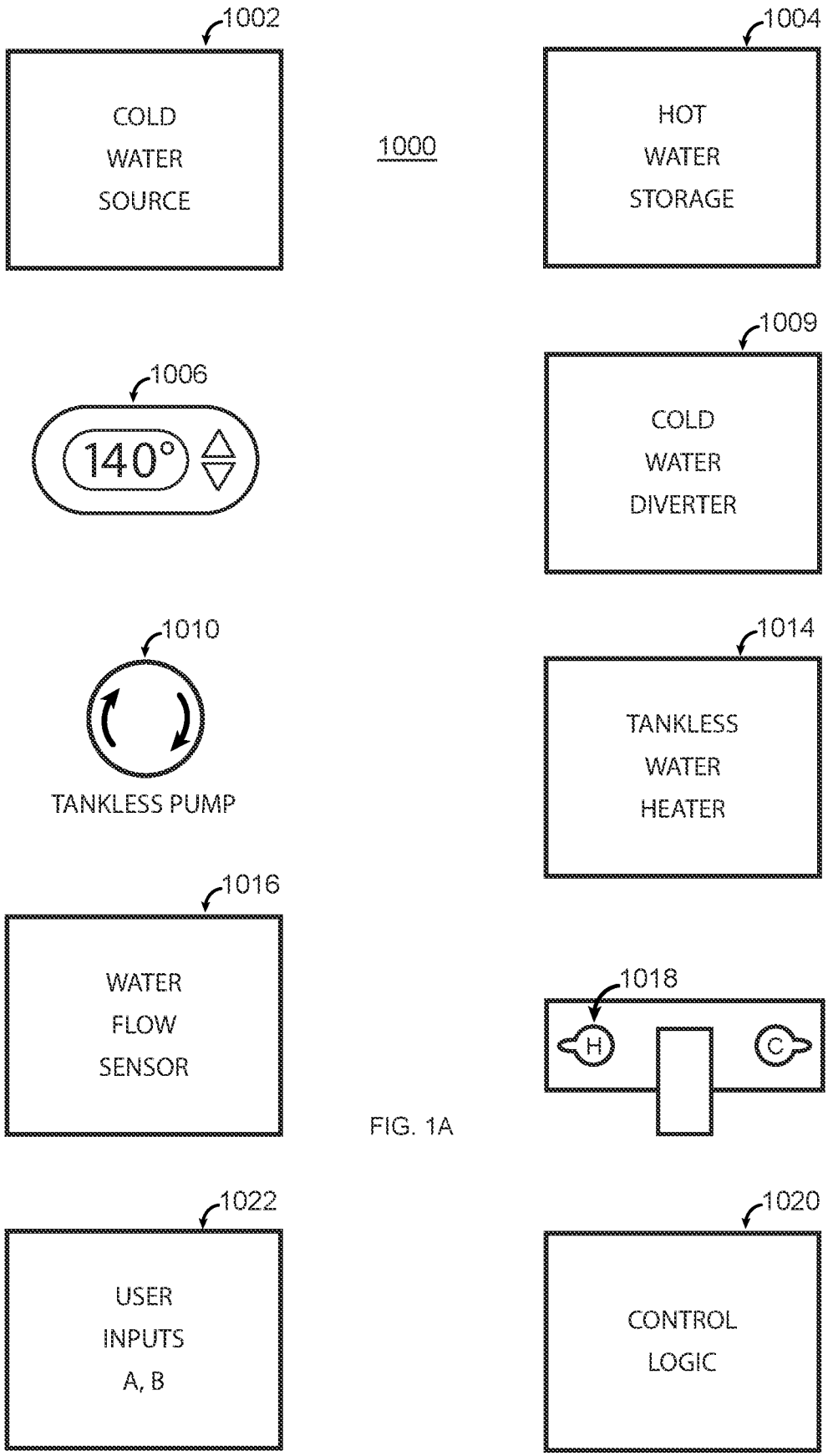
FIG. 1A illustrates an example system for supplying hot water according to the teachings herein.

FIG. 1A illustrates the components of an example apparatus or system 1000 for supplying hot water, such a domestic hot water (DHW) system, according to the unique approach described herein. A cold water source 1002 such as a municipal supply or a private well, provides water used by the system 1000. A hot water storage tank 1004 can receive water from source 1002 and has an associated thermostat 1006. A cold water diverter 1009 can be used to control flow of cold water into hot water tank 1004. A tankless water heater 1014 provides heated water to tank 1004 such as via recirculation pump 1010. A flow sensor can determine when heated water has been requested from the system 1000 such as to be drawn by opening a hot water tap 1018. It should be understood that FIG. 1A is a high level schematic, and that a working system will include numerous sections of water pipe. These water pipe sections are not shown here for the sake of clarity, but are shown in more detail in other figures that are described later on.

Control logic 1020 and user control inputs 1022 operate these components to efficiently supply such hot water to tap 1018 on demand. Control logic 1020 may consist of hard-wired circuits, one or more programmed digital controllers, or some combination thereof, as will be understood by those of skill in the art.

Figure 1B:
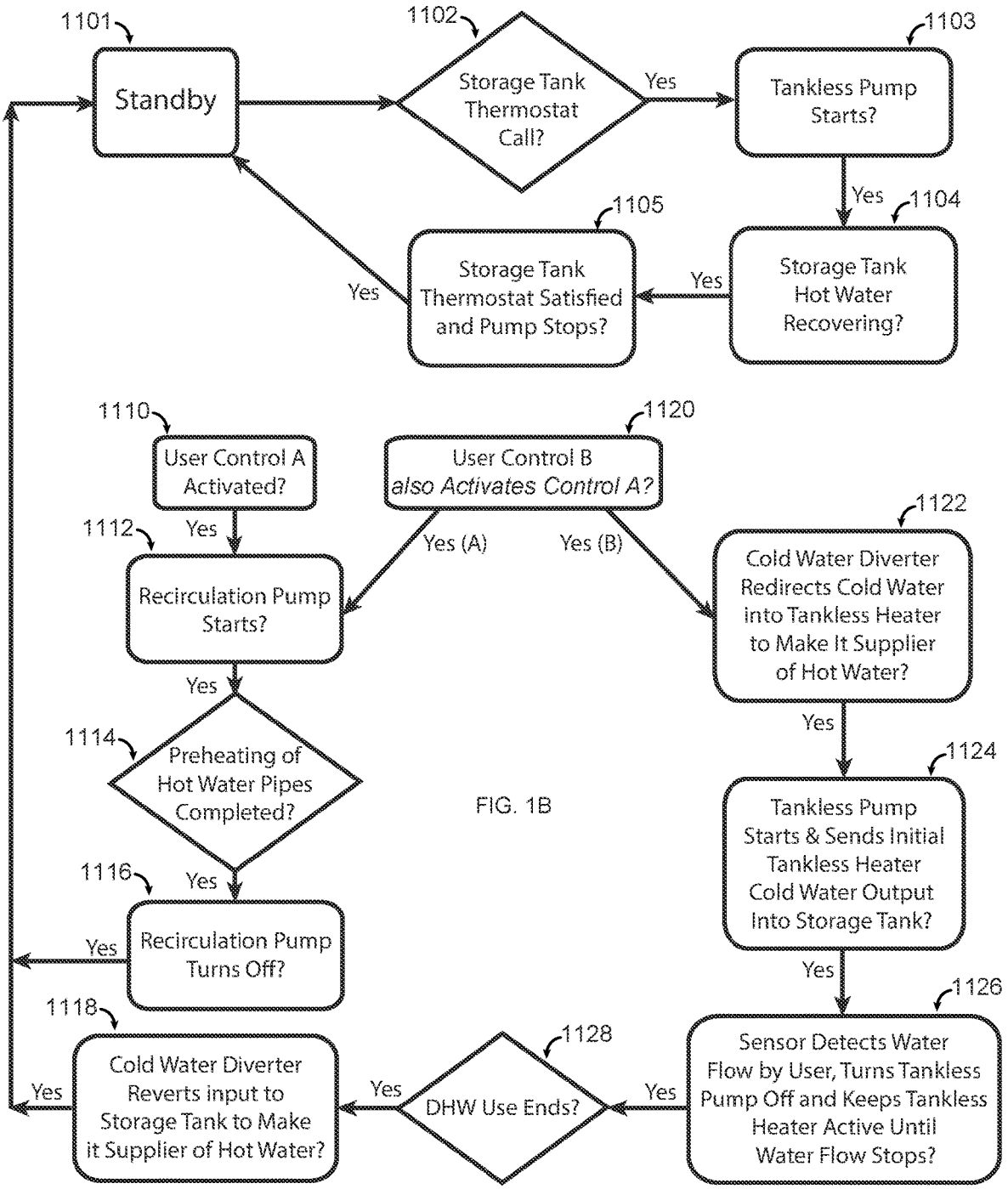
FIG. 1B is a functional block diagram of a method for supplying hot water according to the teachings herein.

FIG. 1B is one example of a functional or logical flow implemented by control logic 1020. This figure should be reviewed in connection with the example system components of FIG. 1A.

State 1101 is a standby mode with the system at rest. Hot water can be supplied by the hot water storage tank 1004 to the tap 1018 as in any conventional system.

In state 1102, thermostat 1006 detects that the tank temperature has reached a low preset hysteresis temperature, such as 136°.

In state 1103, the tankless pump 1010 is activated to circulates water from the storage tank cold input 1002, through the tankless heater 1014 to heat the water, then into a hot water port of the storage tank 1004. State 1104 is entered where the hot water tank continues to recover from the low temperature state. When the tank thermostat 1006 reaches an upper hysteresis temperature, like 140°, as detected by the tank thermostat 1006, a state 1105 is entered, when the storage tank is satisfactorily heated. The tankless pump 1010 is shut off, the tankless heater 1014 also turns off, and the system will go return to standby mode 1101.

In state 1110, a first User Control (A) 1022 is activated when a user decides to preheat the bathroom hot water pipes, and only needs a relatively small amount of hot water. For example, this may be for use at a bathroom sink or bidet use. In state 1112 recirculation pump 1010 is activated to safely send hot water from the storage tank 1004 to the bathroom pipes and back to the storage tank 1004. State 1114 monitors when the pipes are safely preheated. The recirculation pump 1010 is then stopped in state 1116, and the control logic reverts the system back to the standby state 1101. A valve can be configured to open when the preheating pump is on and close when the preheating pump is off. This can help prevent a thermosiphon from occurring.

In state 1120, another User Control (B) initiates the identical function that was started by User Control (A) to preheat hot water pipes via states 1112, 1114, and 1116.

User Control (B) (or some other user control) may also initiate three states that utilize various devices to control hot water flow, including: state 1122 (cold water diverter 1009), state 1124 (tankless pump 1010) and state 1126 (water flow sensor 1016).

More particularly, state 1124 activates the cold-water diverter 1009 so that it will redirect cold water input to the hot water system into the tankless heater 1014, instead of the storage tank 1004. This enables the tankless heater 1014 to now be the continuous supplier of hot water to the system 1000 instead of the storage tank 1004.

State 1124 activates the tankless pump 1010 to send the initial cold-water output of the tankless heater 1014 into the storage tank 1004. This avoids introducing cold water into the hot water pipes.

In state 1126 the water flow sensor 1016 signals to the controller 1020 that hot water use has started (that is, the hot water tap 1018 has been opened). This causes the tankless pump 1010 to be stopped.

When the water flow sensor 1016 signals that hot water use has ended. This transitions to state 1128 where the cold-water diverter 1009 reverts the cold-water input to the hot water storage tank 1004 cold-water input, to again make it the supplier of hot water. At this point, the system then reverts to standby state 1101.

Figure 2A:
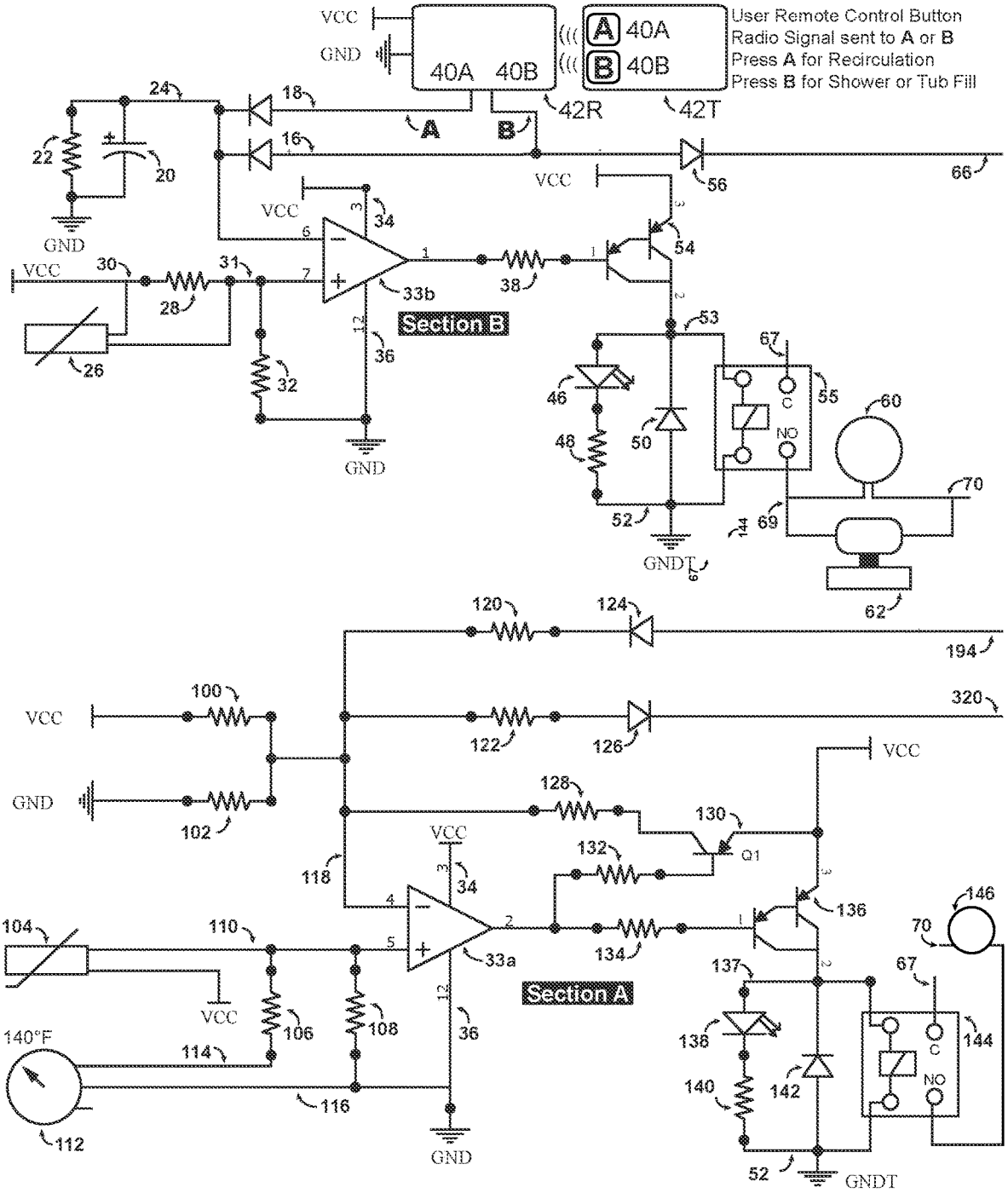
FIGS. 2A and 2B are a schematic of a control circuit, where
Figure 2B:
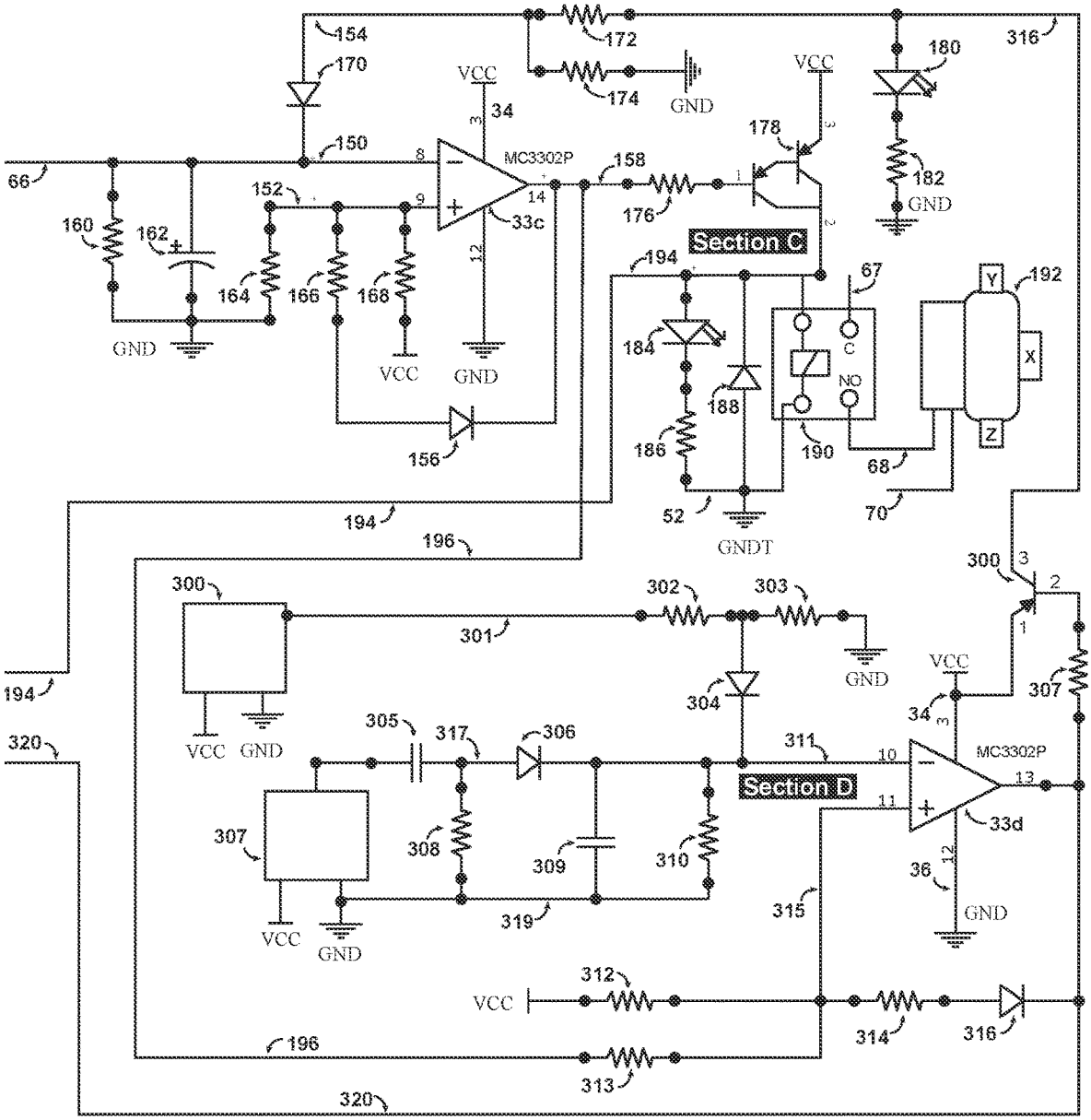

FIGS. 2A and 2B together illustrate a schematic for an example of a control circuit that implements the flow of FIG. 1B in the system of FIG. 1A. The control circuit and other components of a hot water system are intended to be installed in a house or building (not shown).

This example uses a quad comparator Integrated Circuit (IC) which could be a Motorola MC3302P. Such a component has been in production for decades, is extremely reliable, inexpensive, and needs no programming.

These figures are further divided into four sections, where each section of these figures relates to a corresponding section of the quad comparator integrated circuit (IC). In other words, each section includes a single comparator component. Section A is labelled with reference numeral 33*a*, Section B as 33*b*, Section C as 33*c* and Section D as 33*d*.

A system user control input (40A) and a user control input (40B) are provided to transmitter 42T which could be an RF transmitter, a voice command, touchpad display, using Bluetooth, WIFI, infrared signals, signaling over house AC wiring. The control inputs can originate from a push button, switch, programmable timer, time clock, smartphone, tablet, programmable device, or other known types of controllers that provide electronic control signals.

Brief Outline of Each Section

Section A, lower portion of the schematic in FIG. 2A. Full control of tank water temperature recovery is provided using the thermistor 104. It is also enabled by Section C (See FIG. 2B) to help initiate tankless supply of hot water. Section A is then disabled by Section D, namely the water flow sensor 307 or sensor 300, to shut off when user starts a hot water flow such as in a shower or for a tub fill.

Section B, upper portion of the schematic in FIG. 2A. This section is the only one that is fully autonomous. Its function is for preheating hot water pipes near bathrooms. This preferred embodiment uses both a time limit and a temperature limit using a thermistor to turn off. It could be limited by either time or temperature as well. Transmitter 42T circuit signaling to a corresponding Receiver 42R circuit provides an input from User Control (A) 40A or user Control (B) 40B to initiate and further control system operation.

Section C, upper portion of the schematic in FIG. 2B. This section is initiated by user Control (B) 40B (See FIG. 2A). This section controls whether hot water is supplied by a hot water tank or by a tankless heater. It controls a cold-water diverter 192 and enables a Tankless Pump 146 when it is needed for preheating the tankless heater, such as for use in shower or tub fill. Its on status is sustained by detection of water flow from Section D.

Section D, lower portion of the right schematic in FIG. 2B. This section is enabled by Section C being active. When it detects water flow, it will maintain Section C in an on state and turn off Section A. When water flow stops, then Section C will turn off by a preset time limit, which turns Section D off as well.

As mentioned previously, the quad comparator sections in FIGS. 2A and 2B are labeled as 33*a*, 33*b*, 33*c*, and 33*d*. The IC pins are numbered are kept in these figures for clarity. As per conventional practice, each of the comparator sections is drawn in the form of a triangle with the flat side on the left and a triangle point on the right. The left side has two pins and the right side has one pin. When the voltage on the top left (designated a negative pin) is higher than the bottom left side (designated as a positive pin) then the right side will have output in the form of sinking current to ground. When the left lower pin is higher than the upper pin, the right side has no output (no ground and no supply of current).

Referring to the common diagram at bottom of FIG. 2B, a power supply input 206 is shown. Symbols are GND to indicate a general circuit board negative power supply. GNDT is a second ground, used solely for the three relays, 55, 144 and 190, the three connected Light Emitting Diodes (LEDs) 46, 138 and 184 with inline resistors 48, 140 and 186. The two grounds GND and GNDT are isolated from each other by two 1,000-volt rectifier diodes 202 and 200 (which may be 1N4007) so that relay flyback is further isolated from the comparator chip MC3302P, its four included comparators and associated electronic parts. The three relay coils also have flyback 1N4007 diodes 50, 142 and 188.

There are two separate ground planes on the circuit board, with both grounds connected to a power supply ground via 1N4007 diodes. The relay, LEDs, and flyback diodes connect via diode 200 to ground GNDT. The MC3302P quad comparator ICS and remaining electronic parts connect via diode 202 to ground, GND. This arrangement keeps the comparator IC and relays stable while a relay coil magnetic field is collapsing.

The three power relays 55, 144 and 190 can be mounted together in a 4" square steel electric box intended for 120 Volt Alternating Current (VAC) wiring, separate from the circuit board housing. The three wire pairs are typically each a different color, but not polarized since the flyback diodes are mounted adjacent to the TIP125 output. The relay coils work with current in either direction.

Details of Quadrant Operation

Referring to the diagram of Section B in FIG. 2A, this quadrant/section controls the preheating pipe functions. The aforementioned user control (A) and user control (B) inputs, in this preferred embodiment, are provided to RF Transmitter 42T at two radio channels 40A and 40B, and the RF Receiver and Decoder 42R process matching 42A and 42B channel outputs.

At rest, capacitor 20 on bus 24, and connected to pin 6 of 33*b*, is at 0 volts. It is kept drained, when this section is at rest, to 0 volts through 2.2 meg Ω resistor 22, to ground GND. This function is temperature by thermistor 26 at pin 7 and a timing circuit on pin 6.

When user control A or B is pressed, the corresponding 42A or 42B channel output a 13.2-volt pulse. A 12.6 v pulse then occurs on bus 24 from the cathode of diode 18 or 16 respectively, that charges capacitor 20 to 12.6 volts. Pin 6 of 33*b* is now higher than pin 7 of 33*b*. Pin 7 of 33*b* is normally at 2 volts when thermistor 26 is at room temperature. This causes an output on pin 1 on 33*b*, 1.2k Ω resistor 38 draws current to turn TIP125 transistor 54 on which turns on relay 55 by energizing its coil. The coil other side is at bus 52 to ground at GNDT. The relay contacts are normally open. Relay terminal 67 is connected to 120 VAC hot. When the relay is energized, its C common connection applies 120 VAC to the NO contact on bus 69 and powers preheating pump (A) 60, and electric valve 62 will also be powered and it will open. Bus 70 is the neutral 120 VAC connection for the two devices 60 and 62. None of the 120 VAC wires or 120 VAC items depicted are on the same circuit board as the lower voltage electronics.

It is anticipated that by using the same circuit board, Section B could be installed to use a time limit only to turn the preheating pump off. This may be desired under certain installation situations. For example, it may be difficult to attach a thermistor to a hot water pipe near the bathrooms.

Figures 4A, 4B:
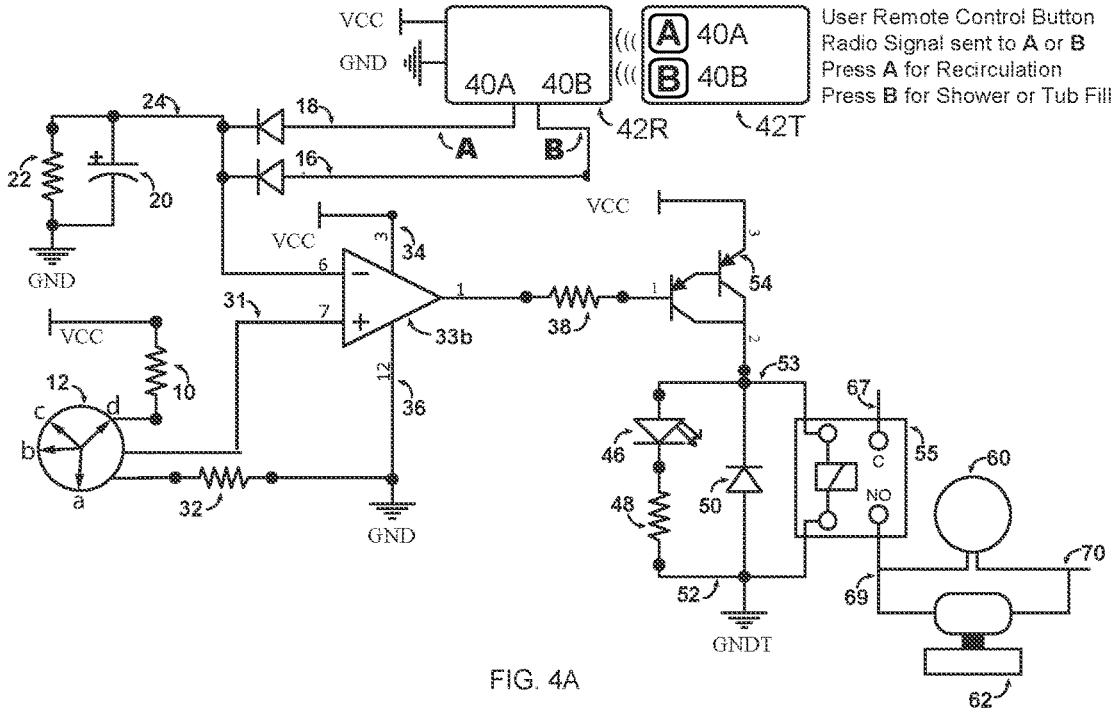
FIG. 4A is a circuit showing how a preheating pump can turn off by time limit only.
FIG. 4B is a table of parameters for the circuit of FIG. 4A.

FIG. 4A and FIG. 4B are an example circuit and its parameters for use as a time limit only, where the time limit is set by the installer or user. The adjustability can be set between 30 and 120 seconds. Alternate builds could easily change the time delay to a special or high range.

To understand how the system may be used as a temperature only shut off for the preheating pump, please see the circuit of FIG. 5A and its parameters in FIG. 5B. This figure shows that an adjustment by installer or user is not needed, since an example setting of 108° F. should not be user adjustable for safety. However, a change in this temperature could be set by replacing resistors 14 and 12 with other values, or via a potentiometer.

Both time and temperature are a preferred embodiment for safety. If the thermistor fails to read the temperature rise, the time limit will shut the pump off. The thermistor will turn the pump off more accurately though.

The electric valve 62 can be a ball valve or a solenoid valve. If it is a ball valve it should be the type that automatically closes when power is removed. A ball valve is preferred as it cannot cause water-hammer. Also, ball valves can be used that work on 12 VDC and have automatic closing by spring or by charged capacitor powering the closing. The TIP125 54 direct output can power a 12 VDC ball valve easily. The 12 VDC for the ball valve can be connected directly to the output connections on the circuit board. It would be exactly where the relay connects, the installer would need to pay attention to correct polarity.

The 2.2 megaohm (MΩ) resistor 22 will drain capacitor 20 to 2.1v in, say, 2 minutes. This voltage is constantly sampled by pin 6 on Section B. There is a voltage divider between thermistor 26 and 6,200Ω resistor 32, to ground at GND. The resistance changes with thermistor temperature. At room temperature, a 71° F. Thermistor 26 is about 5,600Ω, the voltage at pin 7 of 33*b* is 6.6 volts. While preheating Pump (A) 60 is running, the thermistor 26 is reacting to the pipe as the temperature increases. While the temperature is increasing, its resistance is decreasing and the voltage at pin 7 of 33*b* is thus increasing. As the temperature reaches 106° F., Thermistor will be at 3,600Ω and the voltage at bus 31, pin 7 will be 8.1 volts. Meanwhile, the voltage at pin 6 of 33*b* is declining with resistor 22 draining capacitor 20. Pin 6 of 33*b* may be the same 8.1 volts as pin 7 about 30 seconds from the start. As pin 7 edges a little higher with more heat and pin 6 of 33*b* goes a little lower over time, Section B will turn off. Transistor 54 will thus turn off, relay 55 will go back to normal off position and preheating pump (A) 60 will turn off and valve 62 will close. In a typical installation the pump may only run for 30 seconds.

A fail-safe mode will occur if the thermistor device wires are disconnected, hot water never arrives, or the sensor is no longer physically attached to a hot water pipe. This is provided for as follows. The voltage divider at pin 7 is set by VCC to 560,000Ω resistor 28 to bus 31 to pin 7, and bus 31 with 6,200Ω resistor 32 to ground GND. Pin 7 without Thermistor 26 attached it will be at 0.15 volts. When capacitor 20 drains below 0.15 VDC, Section B will turn off, resulting in pump 60 turning off and electric valve 62 closing as well.

Section A

The bottom of FIG. 2A details Section A. The comparator 33*a* from the MC3302P chip has terminals with designations of pins 4(−) and 5(+) on the input (left) and pin 2 (output) on the right. This Section A primarily controls Tankless Pump (B) 146. The circuit around Section A is engineered and adjusted to turn Tankless Pump (B) 146 on when the storage tank temperature goes down to 134° F. and off when hot water is recovered to 140° F. The upper temperature is user adjustable by potentiometer 112, while keeping 6° F. of hysteresis. See hysteresis, pump turn-on and turn-off calculations on FIG. 3.

Resistor 100 and 102 are each 2,400Ω and provide a voltage reference of 6.3 volts on bus 118. That reference is available on pin 4 of 33*a* via bus 118. Thermistor 104 is connected to VCC on one side, and to pin 5 of 33*a* via bus 110. The 18k Ω resistor 108 connects to pin 5 via bus 110 and to ground GND. From bus 110, 910Ω resistor 106 connects via bus 114 to the 5k potentiometer 112 side post. The potentiometer 112 is connected to ground from its center post to ground via bus 116.

When pin 2 turns on, it activates TIP125 transistor 136 through 1.2k Ω resistor 134, at its gate pin 1 and its pin 3 for VCC. Transistor 136 activates relay 144, the C common terminal 67 is connected to 120 VAC hot. The NO normally open terminal and powers Tankless Pump (B) 146. Bus 70 is the neutral 120 VAC connection for the pump 146. None of the 120 VAC wires or 120 VAC items depicted are on the circuit board. Diode 142 is the clamping diode 1N4007 142 across the relay coil, anode to ground GNDT. LED 138 turns on, powered by TIP125 136, and grounded through 1.2K Ω resistor 140.

Hysteresis calculations are provided in FIG. 3.

One purpose of this quadrant is to use a thermistor to maintain the hot water tank temperature. When the tank temperature lowers to 134° F., the voltage on bus 110 to pin 5 of 33*a* is 6.41 VDC, it's lower than pin 4 at 6.42 VDC. 33*a* turns on and has output on pin 2, and through 1.2K Ω resistor 134 and TIP125 transistor 136 turns on. It powers relay 144 coil; the other coil side is at ground GNDT. The relay powers Tankless Pump (B) 146 which will recover the tank temperature to 140° F. in approximately 8 minutes for a 7-gallon tank. At the same time as the recovery starts, the 2N4403 PNP transistor 130 is turned on by 91k Ω resistor 132. Transistor 130 gets supply current from VCC and output current through 16k Ω resistor 128. The increased voltage on bus 118 rises to 6.72 from 6.30 volts to provide hysteresis. When thermistor 104 detects 140°, its voltage on bus 110 to pin 5, will be just above 6.72 volts and turn 33*a* off. Transistor 136, transistor 130, relay 144 and Tankless Pump (B) 146 will all turn off. As soon as 33*a* start to shut off, the hysteresis drops out and a clean shut off is assured. Voltage on bus 118 will return to 6.3 volts. The thermistor 104 has resistance of 3,377Ω at 134° F., and 3,041Ω at 140° F.

Section C

The next quadrant in this description is shown in detail in the upper portion of FIG. 2B. Comparator 33*c* in this quadrant is accessible via input pins 8(−) and 9(+) on the left and pin 14 (output) on the right. Section C generally controls the cold-water diverter valve 192 which controls whether hot water is supplied by the storage tank (default) or hot water is supplied by the tankless heater.

When Section C is at rest, pin 8 is normally at 0 volts. 4.7m Ω resistor 160 to ground GND and capacitor 162 is normally drained to 0 VDC.

Pin 9 is 3.8 volts, based on the two reference resistors. They are 51k Ω resistor 168 from VCC to pin 9 on bus 152, and 22k Ω resistor 164 from bus 152 pin 9 to ground GND. Since pin 9 at 3.8 VDC is higher than pin 8 at 0 VDC, there is no output at pin 14.

User control (B) sends a pulse to 33 microfarad (μf) capacitor 162 via bus 66 and charges it to 12.6 volts. 4.7MΩ resistor 160 will discharge capacitor 162 in 4 minutes if not kept charged by Section D, the water flow sensor while it detects water flow. This will initiate system conversion to tankless heater continuous supply of hot water for a shower or tub fill.

Section C now has output at its pin 14 on bus 158, and diode 156 draws current through 22k Ω resistor 166 on bus 152, pin 9. For hysteresis of comparator 33*c*, pin 9 is now 2.5 volts, it previously was 3.8 volts. Stability comes into play when pin 8 goes below 2.5 volts, pin 9 will jump back up to 3.8 volts, causing a very clean voltage differential of 1.3 volts instead of just a few millivolts. That creates a very sharp Section C shut off.

Section C, pin 14 supplies gate current through 1.2k Ω resistor 176 for the TIP125 transistor 178 to turn on. Circuit board LED 184 turns on with 12 VDC from TIP125 transistor 178 and ground through 1.2k Ω resistor 186 and to ground at GNDT. Relay 190 is activated. Clamping diode 188 goes from bus 194, anode to ground GNDT.

Relay 190 sends 120 VAC to 192 the cold-water diverter through wiring 68, with wire 70 being the neutral side of the 120 VAC. Cold water diverter now directs water through output Y (tankless cold-input) instead of Z (tank cold-input). Now, when water is turned on and a shower or tub fill starts, cold water will enter the tankless heater cold input and no longer to the hot water tank, making the tankless heater the supplier of hot water. TIP125 178 output will send 12.6 v through bus 194, diode 124 and 1.2k Ω resistor 120, to bus 118 and pin 4 of 33*a*, Section A. It will raise pin 4 to 10.3 volts, causing an output of 33*a* at pin 2. Relay 144 will turn on, connecting 120 VAC to turn on Tankless Pump (B) 146. The purpose of this is to pump the initial cold-water output from the tankless heater into the hot water tank to be sure no cold water enters the hot water pipes. Note: bus 194 and bus 196 are shown as crossing over one another on FIG. 2B, but per the usual electrical schematic conventions, are not connected.

Within a minute or two, hot water connecting pipes and the tankless heater are heated, and the cold water sandwich is now gone without wasting any water. The hot water tank temperature is also lifted a degree or two. This assures that when the user turns the shower on, hot water will arrive in 3-6 seconds. Users are advised to spend a minute or two getting ready for the shower while the system is getting ready to provide the shower. No water goes to the drain until the user turns the water on and gets in their shower. In the past, users would turn the shower on, leave the bathroom, and get ready for the shower, allowing gallons of water and some heat to go down the drain.

Section D

This section, illustrated at the bottom of FIG. 2B, works with one of two types of Water Flow Sensors (WFS). The top WFS 300 is a direct current output WFS. It works by having a small magnet mounted in a slidable plastic shuttle moveable against a spring when there is water flow. When it moves, a hall switch detects the magnetic field and closes, and it sends constant 12 VDC output to bus 301. This type of WFS has inputs for power VCC and GND. The 12 VDC output on bus 301 leads to two resistors in series 2.4M Ω resistor 302 and 1.1m Ω resistor 303 to GND. From the 302 and 303 connection, diode 304 delivers 3.7 VDC to pin 10 of bus 311 and pin 10 of Section D.

The bottom WFS 307 has a pulsed DC output. This style of WFS has a waterwheel in the flow of water (shaped like a propeller). One blade of the waterwheel has a small magnet embedded in an outer blade. A small IC circuit detects pulses and forms them into a dc pulsed square wave output. This output needs to be transformed into a reasonably smooth DC voltage, allowing the Section D to detect output. The current test installation uses a 307 type of water flow sensor, experience shows that it is more reliable.

The smoothing circuit from water flow sensor 307 output connects to 0.334 μf capacitor 305, and bus 317 to diode 306 anode, its cathode to bus 311 leading to 33*d*, pin 10. 1mΩ resistor 308 goes from bus 317 to bus 319 ground GND. Capacitor 0.334 μf 309 goes from bus 311 to bus 319. 5.6m resistor 310 goes from bus 311 to bus 319 GND.

This Section D is only enabled after comparator 33*c* is enabled because its intention is to keep Section C on while a shower or tub fill is in use, or 4 minutes after water flow is shut off.

Pin 10 of comparator 33*d* is normally held at 0 volts through bus 311 connects to 5.6MΩ resistor 310 and its connection to ground at GND. Pin 11 of 33*d* is held to 12.6 volts through bus 315 by 1.1m resistor 312, 1.1M Ω and its connection to VCC.

When Section C has output at pin 14, bus 196 will provide a ground for 150k Ω resistor 313, and lower the voltage of pin 11 on 33*d* to 1.9 volts. That will allow the WFS to turn 33*d* on when water flow is detected. 33*d* pin 10 will go to 4 VDC when water flow is detected, pin 11 will be at 1.9 volts and 33*d* will have output on pin 13. Pin 13 output has three functions.

First, it turns PNP 2N4403 transistor 300 on through 10k Ω resistor 307, and provides positive voltage up to bus 316. A voltage divider on bus 316, using 3.3k Ω resistor 172, positive side, and 1.2k Ω resistor 174, negative side to GND creates 3.9 volts on bus 154 and extends through diode 170, to bus 150. This voltage boost keeps capacitor 162 charged to 3.9 volts so that Section C will stay active while water flow is detected. This allows a shower or tub fill to keep the cold-water diverter from timing out and reverting to storage tank hot water until 4 minutes after the water flow stops when capacitor 162 will drain to 0 VDC through 4.7m Ω resistor 160. The circuit board LED 180 turns on from bus 316 positive voltage, using 1.2k Ω resistor 182 to ground GND.

Second, bus 315 to pin 11 is pulled down to 1.1 volts by a voltage divider with VCC to 1.1m Ω resistor 312, 91k resistor 314 and diode 316 connected to 33*d*. At this point pin 13 (sinking current), connects bus 196 to 150k Ω resistor 313 to bus 196 and ground at 33*c* pin 14 (sinking current).

Third, output from 33*d* at pin 13 also draws current from bus 320. Bus 320 connects to diode 126 and 11Ω resistor 122 to lower the voltage on comparator 33*a* pin 4. Pin 4 goes to 1 volt dc and turns Section A off, which turns shuts the tankless pump 146 off. Preheating the tankless heater and associated pipes is complete and full mode tankless hot water supply is running. No pumps need to run during the shower or tub fill. Only the cold-water diverter needs to keep water flowing into the tankless heater and not the storage tank. The water flow sensor keeps everything in its correct tankless state. Four minutes after the water flow sensor reports no water flow, resistor 160 will have drained capacitor 162 below the 2.5 VDC of pin 9 on 33*c*, and 33*c* will turn off, allowing cold water diverter 192 to redirect future cold-water input to the storage tank cold water input. Hot water will now be supplied by the storage tank. The circuit is at rest.

A temperature limit or time limit can be used to stop the preheating pump 60. The preferred embodiment for safety uses both time limit and temperature limit to turn the preheating pump off. There are situations where an installer may need to have either temperature limit or time limit as the way to turn the preheating pump off. It may be that the installer has no easy way to attach a thermistor to a bathroom pipe and needs to have time limit as the only way to shut the pump off. On the other side, there may be a decision to turn the pump off by temperature only. The circuit board schematic and layout would be slightly different than the description of Section B at the very beginning of the detailed description.

FIGS. 4A and 4B TIME ONLY for Preheating Pump Turn Off.

As shown in FIG. 4A and FIG. 4B, a time limit only mode has a potentiometer 12 to adjust the desired run time. It could be between 20 seconds and 120 seconds. The installer would test the pipe temperature while its running to see what a good run time is. The homeowner or user could be able to adjust this as well.

In this design, a 2 M Ω resistor 22 would allow the pump to run for a maximum time, for example, 2 minutes, before turning the pump off. Capacitor 20 remains 33 μf. The time is adjustable by potentiometer 12 that adjusts pin 7 voltage which pin 6 must "beat" in order to shut the preheating pump off. Pin 7 can be adjusted between 1 volt and 9 volts by the potentiometer 12. The potentiometer doesn't change the time delay in resistors 22 and capacitor 20, rather, it changes the goal set at pin 7. When pin 7 is higher, the goal is quicker to reach, when pin 7 is lower, the capacitor voltage must drain to a lower target. In FIG. 4B, the table shows the "wiper" (potentiometer arm) goal.

FIG. 5A and FIG. 5B Preheating Pump Turn Off by Temperature Limit Only

FIG. 5A and FIG. 5B show a temperature-only mode that is designed to turn the preheating pump off when the bath pipe temperature reaches a preset temperature, for example, 108° F. When the system is preheating, the preheating pump will be activated. A 13.2 VDC pulse goes through diode 18 or 16 to bus 24 and energizes the voltage divider across 5.1k Ω resistor 14 and 5.6k Ω resistor 12. Diode 18 or 16 reduces the supply voltage by 0.6 volts, leaving 12.6 VDC on bus 24. The voltage on bus 30 to pin 6 of Section B will be steady at 6.59 VDC. When the user control is activated, 33*b* will turn on instantly and have output of 12 VDC on bus 53. That voltage, through diode 10 will keep the voltage applied on bus 24, allowing 33*b* to stay on, until pin 7 of 33*b* goes to a higher voltage than 6.59 VDC.

Resistance of Thermistor 26 is 11,720Ω at 70° F., room temperature, and resistor 32 is 5.6k Ω. That creates a voltage of 4.07 VDC on bus 31, and thus at pin 7 of 33*b*. As Thermistor 26 reacts to the pipe temperature increases, its resistance goes down. At 108° F., Thermistor 26 will have a resistance of 5,053Ω. Now, bus 31 pin 7 has a higher voltage of 6.62 VDC vs pin 6 of 33*b* at 6.59 VDC. Section B output will thus stop and the preheating pump will turn off.

If user control (A) or (B) is used while the pipes are already hot, the pump will not run, since pin 7 is already higher than pin 6 of 33*b*. Thermistor will return to room temperature and 11,720Ω a while after hot water flow stops. If user control (A) or (B) is pressed while the circuit still determines the pipes remain hot, then preheating pump 60 will not run.

Figure 6:
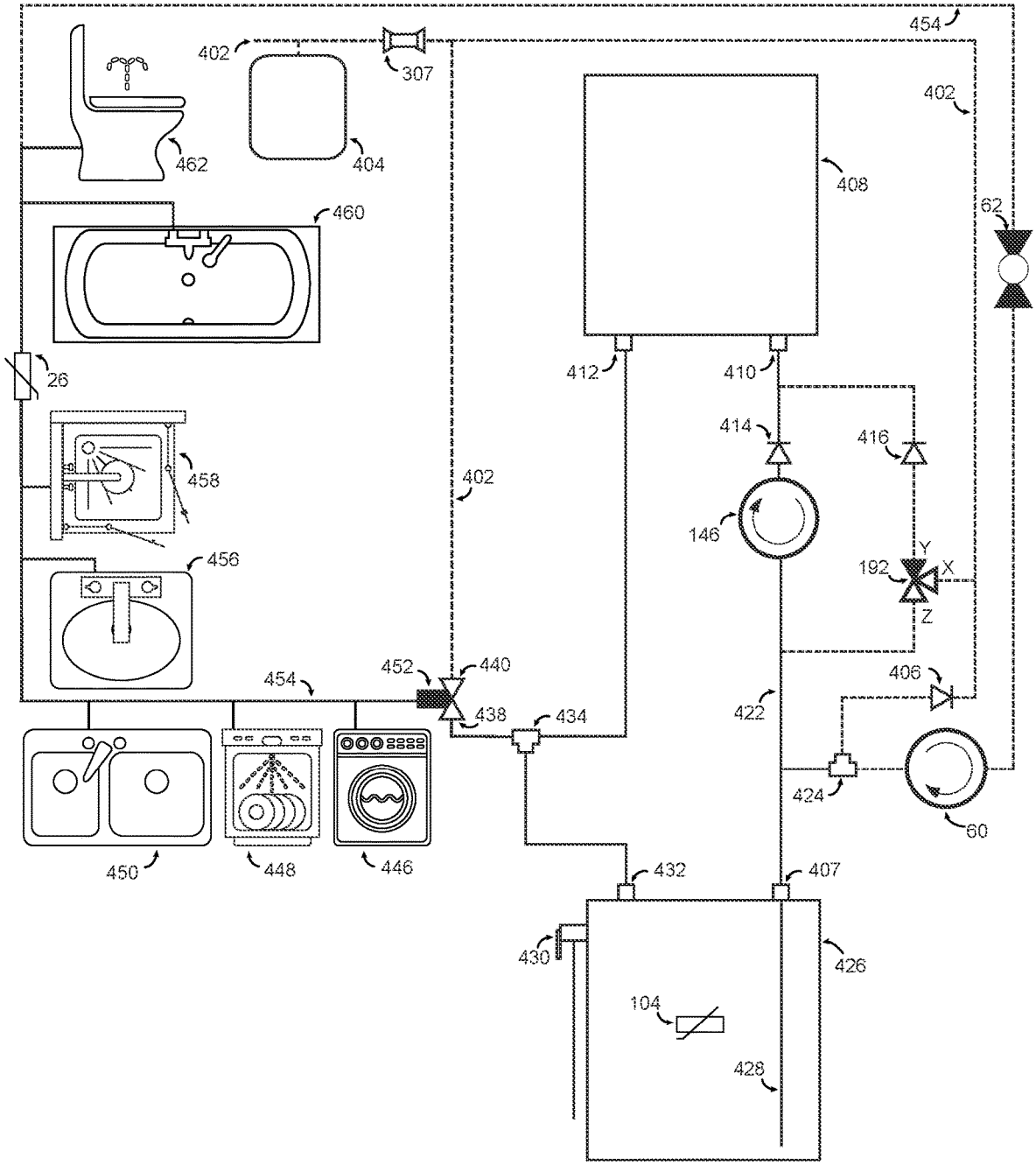
FIG. 6 illustrates an example implementation of piping, plumbing, fixtures and appliances that utilize the system.

FIG. 6 Piping, Plumbing Fixtures & Appliances

The following list of ID numbers should be referred to for the piping and plumbing fixture diagrams in FIG. 6.

26 Thermistor on hot water pipes near bathrooms
60 Recirculation Pump
62 Electric water valve, normally closed
104 Thermistor on hot water storage tank
146 Tankless Pump
192 Cold Diverter Valve: Flow is X to Z default state, X to Y when activated
307 Water flow sensor
402 Municipal or well water source, dashed lines represent cooler water.
404 Heating System Expansion Tank
406 Check valve prevents cold water from bypassing diverter valve 192
407 Storage tank cold water port
408 Tankless Heater
410 Tankless Heater cold water input
412 Tankless Heater hot water output
414 Check Valve to prevent water flow out of cold input of tankless heater
416 Check Valve prevents water flow through pump 146 going in the wrong direction
424 Tee 424 creates a new branch to allow for apportionment of room temperature return water. The Tee 424 has one input, from pump 60. Tee 424 has two outputs: the top one goes to check valve 406 to pipe 402 and enters port 440, the cold-input of tempering valve 452. The second Tee 424 output goes into cold-input 407 of tank 426. The tempering valve 452 draws needed hot water from port 432 of tank 426. Tee 424 provides for that requirement through tank 426.
426 Hot water storage tank
428 Storage tank internal dip tube
430 Storage tank P&T safety valve
432 Storage tank hot water port
434 Plumbing Tee, specially arranged, please see detailed description
438 Tempering valve hot water inlet port
440 Tempering valve cold water inlet port
446 Washing Machine
448 Dishwasher
450 Kitchen Sink
452 Tempering valve (anti-scald)
454 Pipe from tempering valve hot water output to ball valve to Preheating Pump 60
456 Bathroom Sink
458 Shower
460 Bathroom Tub
462 Bidet FIG. 6 Piping, Plumbing Fixtures and Appliances An explanation and background of preheating bathroom pipes and apportionment of circulated return water will now be provided in connection with FIG. 6. This figure illustrates a plumbing arrangement required for safe preheating of hot water pipes.

Piping details: Water enters the system through pipe 402 where expansion tank 404 can absorb excess hot water when the heating of water expands the volume. Normally, the water flows through pipe 402 to the diverter valve 192 input port X. While the system is normally in a mode of using the tank supply of hot water, diverter 192 sends the cold water out from port Z of the valve. Water can now enter the storage tank cold water port 407 and push out hot water from the tank's hot water port 432. Water then enters tee 434 and continues flowing to tempering valve 452, and hot water in port 438. The tempering valve 452 uses cold water from its port 440 and pipe 402. Tempering valves such as 452 measure the output constantly and proportions the incoming volume of hot and cold water to output the preset, safe hot temperature.

The plumbing items shown in FIG. 6 are examples of fixtures that function more efficiently using hot water from a storage tank that is preheated by a tankless heater. These can include, for example, a washing machine 446, dishwasher 448, kitchen sink 450, bathroom sink 456, and/or bidet 462. Hot water provided from a storage tank is available more quickly, and the storage tank has been heated efficiently with the tankless heater. However, short intermittent use of a tankless heater by washing machines, dishwashers, kitchen, and bathroom sinks is inefficient for tankless heaters because condensing flue temperatures are never reached when its used intermittently. Short cycling use also harms the tankless heater.

The approach described herein is an improvement over such systems. Here, when a user activates Control (A), preheating pump 60 is started. Ball valve 62 is opened. Water is pumped through the hot water tank 426, entering the cold port 407 and exits with hot water tank from port 432. Water then passes through tee 434 and enters the hot side of the tempering valve 452. The pump also sends cool water through the branch circuit created by tee 424, and check valve 406 and continues through pipe 402. and then enters the cold-water port 440 of the tempering valve 452. The valve 452 now has the water temperature resources to output properly tempered recirculation water to pipe 454.

Thermistor 26 is physically attached to hot water pipes near the bathrooms or other hot water usage location. When the circuit determines that the pipes have reached 106° F., then the pump is shut off by the circuit. If heat doesn't arrive, the pump shuts off by a timer in two minutes. Ball valve 62 closes when pump 60 stops.

Now the user can turn on the hot water for a sink, shower or bidet and hot water will arrive in 3-5 seconds. Very little water is wasted down the drain as compared to many minutes of water down the drain, if the pipes were not preheated.

For a shower or tub fill, a user activates Control (B). It activates the full preheating function just described when using Control (A), and this activation of Control (B) also switches the system to the tankless heater supplying continuous hot water for a shower or tub fill.

User Control (B) activates the tankless pump 146 and sends its output through tee 434 and into the storage tank 426, port 432. This initial tankless output contains cold water. Tankless pump 146 sends this initial cold water into the storage tank to assure cold water is not distributed into the hot water pipes. As the tankless pump 146 continues, the storage tank temperature is recovered a degree or two after being exposed to the tankless initial cold water, a.k.a. a cold-water sandwich.

User Control (B) also activates the cold-water diverter 192, which will switch its cold-water output at port Y and to port 410 the cold-input of tankless heater 408. When the user turns the shower on, the water flow sensor 307 will stop tankless pump 146.

Four minutes (or some other specified time) after the Water flow sensor 307 determines the water use is still off, the cold-water diverter 192 redirects future cold water back to X to Z flow and to the hot water tank port 407.

If the shower is never turned on (maybe the user answers a phone call), the system will stop tankless pump 146 in 4 minutes (or other specified time) and the system will go to rest and revert to water tank supply of hot water.

Figure 7:
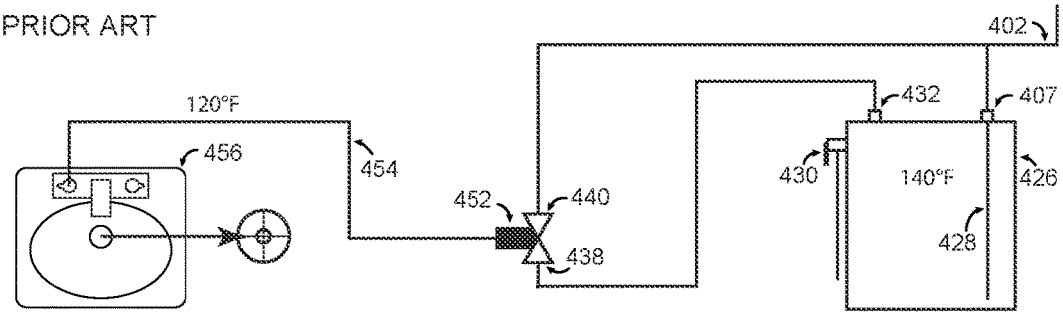
FIG. 7 PRIOR ART
FIG. 7 shows a normal hot water system, with an anti-scald valve 452.

FIG. 7—Safe and Normal Hot Water Use

FIG. 7 shows a typical use case. Water is drawn from sink 456, using the hot water faucet on the sink and water flows down the drain or it fills the sink. This causes a lower pressure in pipe line 454. That draws water from the output of tempering valve 452 into pipe 454. In response, there is a draw of water from the tempering valve's hot-input 438 and cold-input 440. Valve 452 controls the proportion of hot and cold water required to temper the output to the set temperature limit. For example, if the hot-input is 140° F. and the cold-input is 70° F., then the mix would be comprised as follows: 71% of 140° F. water into port 438 and 29% of 70° F. water into port 440, the result would be 120° F. to pipe 454 going to the sink hot water faucet.

Figure 8:
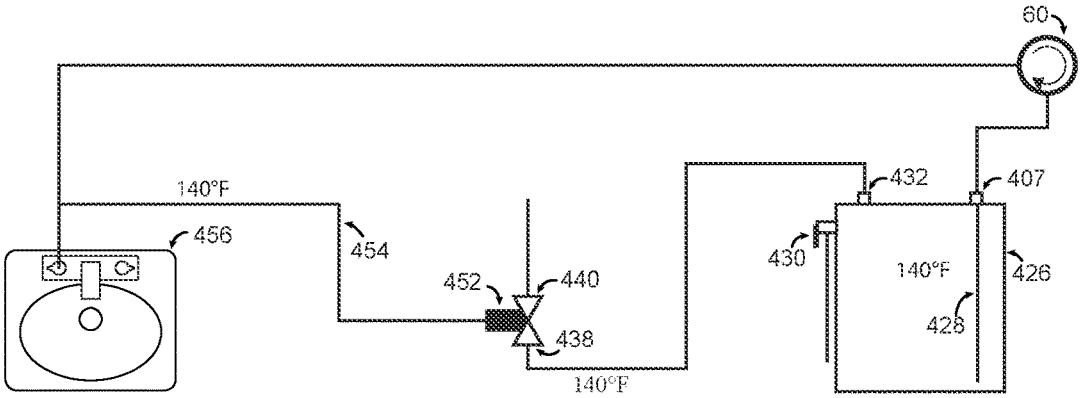
FIG. 8 shows unsafe preheating, where the anti-scald valve 452 cannot work properly.

FIG. 8—Unsafe Preheating

Circulation piping: this is the way typical hot water circulation systems fail to allow the tempering valve to work. Pump 60 sends 100% of return pipe water into the hot water tank cold-input, forcing hot water out of the tank's hot-output port 432. Since there is no water being drawn through a faucet to a drain, the piping system is closed and fresh cold water cannot enter the tempering valve at its cold-input port 440. That means that there is no tempering of the water, and only the full hot water tank temperature is circulated. If 140° F. is presented at port 438 and 70° F. presented at port 440, 100% of the 140° F. water will be allowed to enter because the hot water tank is part of the loop. Zero percent of the cool return water will be allowed to enter the loop because 100% of the hot water is the only circulated water.

The pump 60 can be anywhere in the loop, it makes no difference. The simple fact that no water is draining out of the system also means that no water can be added in. Once the pipes are full, there is no room for more.

Figure 9:
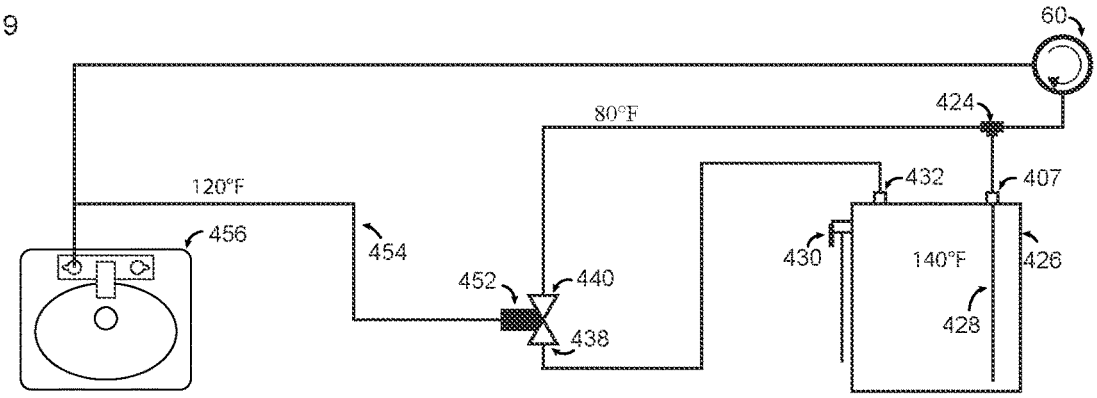
FIG. 9 shows safe, apportioned return water using branch tee 424, with anti-scald valve 452 working properly.

FIG. 9— Safe Preheating with Apportioned Return Water

FIG. 9 illustrates a improved arrangement of pipes to allow tempering of the tank's hot water. A new piping branch is incorporated into the return water piping. In this diagram, Tee 424 allows for apportionment of the cool return water. Tee 424 has one input from pump 60 and two outputs. The first output goes to cold-port 440 of the tempering valve 452, and the second output is to port 407 the cold-input of tank 426. The tank then supplies that water as hot water out of port 432 of the tank, to hot-input port 438 of the tempering valve 452. The tempering valve 452 thermal wax module will move its shuttle to proportion the correct amount of hot water and cold water to obtain the preset output temperature that enters pipe 454.

Mixing water temperature using warmer return water, still works great here: if the hot input is 140° F. and the return input is 80° F., then the mix volume would be comprised as follows: 66.7% of 140° F. water volume into port 438 and 33.3% of 80° F. water volume into port 440. That would send 120° F. to the sink hot water faucet.

Design Options

It should be understood that the above description is meant as an example only, and that numerous modifications to the specific components and operation can be provided without departing from the spirit of this patent.

The circuits are designed to close valves, sense water flow, or perform other functions at particular times. Other times and other sequences of operation are possible.

Other operating parameters may be changed as well. For example, families with young children might chose to set lower temperatures at the tempering valve or thermostat.

The disclosure is also not limited by the name of each component described above, and in the case of a logical component or entity performing the above-described functions, the configuration of the disclosure may still be applied.

In addition, the different controllers, circuits, and logical nodes may be physically located in the same or different physical location as other logical nodes, and may be provided with a function by the same physical device (e.g., a processor, a controller, etc.) or by another physical device. As an example, the function of at least one logical node described herein may be provided through virtualization in one physical device.

The methods, systems, and devices discussed above should be considered to be examples. Various configurations may omit, substitute, or add various procedures or components as appropriate. For instance, in alternative configurations, the methods may be performed in an order that is different from that described, and/or various stages may be added, omitted, and/or combined. Also, features described with respect to certain configurations may be combined in various other configurations. Different aspects and elements of the configurations may be combined in a similar manner. Also, technology evolves and, thus, many of the elements are examples and do not limit the scope of the disclosure or claims.

Also, configurations may be described as a process which is depicted as a flow diagram or block diagram. Although each may describe the operations as a sequential process, many of the operations can be performed in parallel or concurrently. In addition, the order of the operations may be rearranged. A process may have additional states or steps not included in the figures. Furthermore, examples of the methods may be implemented by hardware, software, firmware, middleware, microcode, hardware description languages, or any combination thereof. When implemented in software, firmware, middleware, or microcode, the program code or code segments to perform the necessary tasks may be stored in a non-transitory computer-readable medium such as a storage device. Processors may then execute the program code to perform the described tasks.

It should be understood that the flow of the example embodiments described above may be implemented in many different ways. In some instances, the various "data processors" may each be implemented by a physical or virtual or cloud-based general purpose computer having a central processor, memory, disk or other mass storage, communication interface(s), input/output (I/O) device(s), and other peripherals. The general-purpose computer is transformed into the processors and executes the processes described above, for example, by loading software instructions into the processor, and then causing execution of the instructions to carry out the functions described.

Embodiments may also be implemented as instructions stored on a non-transient machine-readable medium, which may be read and executed by one or more procedures. A non-transient machine-readable medium may include any mechanism for storing or transmitting information in a form readable by a machine (e.g., a computing device). For example, a non-transient machine-readable medium may include read only memory (ROM); random access memory (RAM); storage including magnetic disk storage media; optical storage media; flash memory devices; and others. Further embodiments may also be implemented in a variety of computer architectures, physical, virtual, cloud computers, and/or some combination thereof, and thus the computer systems described herein are intended for purposes of illustration only and not as a limitation of the embodiments.

For example, the "user controls" may be operated by human input devices such as switches, or operated by programmed processes. Furthermore, process flows or system components may be described herein as performing or including certain actions and/or functions. However, it should be appreciated that such descriptions contained herein are merely for convenience and that such actions in fact result from other similar devices, processors, or controllers.

The above description has particularly shown and described example embodiments. However, it will be understood by those skilled in the art that various changes in form and details may be made therein without departing from the legal scope of this patent as encompassed by the appended claims.

The invention claimed is:

1. An apparatus for preheating hot water pipes, the apparatus comprising:

a hot water tank having a cold-input and hot-output;

a recirculation pump arranged to circulate hot water from said hot-output through a closed piping loop;

a control, configured to turn on the recirculation pump to provide return water from the closed piping loop via a return pipe;

a branch piping circuit having an input and an outlet for apportionment of said return water;

a tempering valve having a cold-input and a hot-input, and configured to temper hot water supplied at a hot-output, such that said tempering valve further controls:

an amount of said return water drawn directly into the cold-input of the tempering valve from said branch piping circuit; and an amount of hot water drawn into said hot-input of the tempering valve from the hot-output of the hot water tank, thereby forcing said hot water tank to draw that same amount of water volume into its cold-input from said return water through the outlet of said branch piping circuit; and thereby facilitating said tempering valve to output hot water at its hot-output at a predetermined temperature.

2. The apparatus of claim 1, further comprising:

a control configured to turn said recirculation pump off when a preset temperature has been reached.

3. The apparatus of claim 1, further comprising:

a control configured to turn said recirculation pump off when a preset time limit has been reached.

4. The apparatus of claim 1, further comprising:

an electric valve disposed in the return pipe that opens when said recirculation pump is on and closes when said recirculation pump is off, said electric valve prevents a potential thermosiphon from occurring in said closed piping loop.

5. An apparatus for supplying domestic hot water comprising:

a hot water storage tank configured to supply hot water;

a tankless heater configured to supply hot water to satisfy a higher demand than the hot water storage tank;

a tank thermostat and a tankless pump configured to recover a temperature of water stored in the hot water storage tank by cycling water from the hot water tank through the tankless heater;

a cold-water diverter configured to direct cold water from a cold-water supply to enter either the tankless heater or the hot water storage tank;

a water flow sensor for sensing a flow of water;

a control configured to control the cold-water diverter to direct cold water to enter a tankless heater cold input instead of a hot water storage tank cold input, thereby enabling the tankless heater to supply hot water, depending on a state of a control input; and the cold-water diverter further configured to direct cold water depending on a state of the water flow sensor, such that when the water flow sensor detects that hot water use has ended, said cold-water diverter directs the cold-water supply to the cold-water input of the hot water storage tank and no longer to said tankless heater, and wherein the water flow sensor stops the tankless pump when use of water is detected or when a preset time limit has been reached.

6. The apparatus of claim 5, wherein the control also activates the tankless pump to send initial cold-water output produced by the tankless heater into the hot water tank to assure that cold water does not enter hot water pipes.

7. The apparatus of claim 5, wherein the water flow sensor imposes a time delay before signaling that water flow has ended.

8. A system for efficient delivery of hot water comprising:

a storage tank configured to supply hot water;

a tankless heater configured to supply hot water to satisfy a higher demand for hot water than the storage tank can provide;

a recirculation pump coupled to circulate water from the storage tank through a closed piping loop and back to the storage tank;

a cold water diverter configured to direct cold water from a cold water supply to either the storage tank or the tankless heater;

a first control (A) configured to control the recirculation pump to circulate hot water from the storage tank through a piping loop and back to the storage tank, to thereby provide return water from the piping loop;

a second control (B) configured to activate the tankless heater by controlling the cold water diverter to direct cold water from the cold water supply to enter the tankless heater instead of the storage tank, thus enabling the tankless heater to be a supplier of hot water; and at least one of a timer or a water flow sensor, configured to control the cold water diverter, and to enable the tankless heater to supply hot water, such that when the timer indicates a preset time limit is reached, or when the water flow sensor indicates that water use has ended, the cold water diverter reverts the cold water supply to the storage tank and no longer to the tankless heater, to thereby enable the storage tank to be the supplier of hot water.

9. The system of claim 8 wherein the second control (B) is further configured to activate a tankless pump to send water output from the tankless heater into the storage tank to further assure that cold water does not enter any hot water pipes.

10. The system of claim 8 additionally comprising:

a branch piping loop having at least one input and at least two outlets and configured for apportionment of return water.

11. The system of claim 10 additionally comprising:

a valve configured to control an amount of return water drawn directly in from the branch piping loop.

12. The system of claim 11 additionally comprising:

a tempering valve having a cold-input and a hot-input, and configured to temper hot water supplied by the system.

13. The system of claim 12 wherein the tempering valve is further configured to control:

an amount of return water drawn directly into the cold-input of the tempering valve from the branch piping loop; and an amount of hot water drawn into the tempering valve hot-input from a hot output of the storage tank, thereby forcing the storage tank to draw that same water volume into its cold input from the return water provided through the branch piping loop.

14. The system of claim 11 additionally comprising:

an electric valve coupled to a return water pipe, and configured to open when the recirculation pump is on and close when the recirculation pump is off, to thereby prevent a thermosiphon from occurring in the branch piping loop.

15. The system of claim 8 additionally comprising:

a control configured to turn the recirculation pump off when the storage tank reaches a preset temperature.

16. The system of claim 8 additionally comprising:

a control configured to turn the recirculation pump off when a preset time limit has been reached.

17. The system of claim 8 additionally comprising:

a tank thermostat and tankless pump configured to recover hot water from the storage tank by cycling hot water from the storage tank through the tankless heater.

18. A method comprising:

receiving a supply of hot water from a tankless heater;

coupling a storage tank through a piping loop and back to the storage tank via a recirculation pump;

diverting cold water from a cold water supply to either the storage tank or the tankless heater; and operating one or more controls configured to:

activate the recirculation pump to circulate hot water from the storage tank through the piping loop and back to the storage tank, to thereby provide return water from the piping loop;

divert cold water to enter the tankless heater via a cold water diverter, thus enabling the tankless heater to supply hot water; and further control the cold water diverter, and thereby enable the tankless heater to supply hot water, such that when a timer indicates a preset time limit is reached, or when a water flow sensor indicates that water use has ended, revert the cold water supply to the storage tank and no longer to the tankless heater, to thereby enable the storage tank to be a supplier of hot water.

* * * * *